US005578265A

United States Patent [19]

Ericson et al.

[11] Patent Number: 5,578,265

[45] Date of Patent: Nov. 26, 1996

[54] FERRITIC STAINLESS STEEL ALLOY FOR USE AS CATALYTIC CONVERTER MATERIAL

[75] Inventors: Lars Ericson; Jan Kutka, both of Sandviken, Sweden

[73] Assignee: Sandvik AB, Sandviken, Sweden

[21] Appl. No.: 516,508

[22] Filed: Aug. 17, 1995

Related U.S. Application Data

[63] Continuation-in-part of Ser. No. 200,362, Feb. 23, 1994, abandoned, which is a continuation of Ser. No. 941,783, Sep. 8, 1992, abandoned.

[51] Int. Cl.[6] ..... C22C 38/18

[52] U.S. Cl. ..... 420/40

[58] Field of Search ..... 420/40

[56] References Cited

U.S. PATENT DOCUMENTS

| | | | |
|---|---|---|---|
| 2,061,370 | 11/1936 | Rohn | 420/40 |
| 2,172,023 | 9/1939 | Gat | 420/77 |
| 2,191,790 | 2/1940 | Franks | 420/4 |
| 2,580,171 | 12/1951 | Mattiasson et al. | 420/62 |
| 2,635,164 | 4/1953 | Rehnqvist et al. | 420/34 |
| 2,703,355 | 3/1955 | Hagglund | 420/34 |
| 3,027,252 | 3/1962 | McGurty et al. | 420/40 |
| 3,171,737 | 3/1965 | Spooner et al. | 420/63 |

(List continued on next page.)

FOREIGN PATENT DOCUMENTS

| | | | |
|---|---|---|---|
| 2161954 | 6/1973 | Germany | 420/41 |
| 48-3927 | 2/1973 | Japan | 420/40 |
| 52-69849 | 6/1977 | Japan . | |
| 53-2328 | 1/1978 | Japan | 420/62 |
| 53-53512 | 5/1978 | Japan | 420/40 |
| 53-118218 | 10/1978 | Japan | 420/40 |
| 54-61340 | 5/1979 | Japan . | |
| 56-65966 | 6/1981 | Japan . | |
| 865957 | 9/1981 | U.S.S.R. | 420/40 |
| 2019886 | 11/1979 | United Kingdom | 420/40 |
| 2081747 | 2/1982 | United Kingdom . | |

OTHER PUBLICATIONS

Aus Chemical Abstracts, 83/46518s, Japan Kokai 74–115, 927, Nov. 6, 1974.

Dr.–Ing. Hans Schmitz, "Stahl–Eisen–Liste", p. 102, 1977.

J. D. Whittenberger et al, "Elevated–Temperature Mechanical Properties and Cyclic Oxidation Resistance of Several Wrought Ferritic Stainless Steels", *Metals Technology,* Nov. 1978, pp. 365–371.

T. Amano et al, "High–Temperature Oxidation Behavior of Fe—20Cr—4Al Alloys With Small Additions of Cerium", Trans. JIM, vol. 20, 1979, pp. 431–441.

Z. Lixin et al, "An Investigation of Residual Stress of Oxide Scale Affected by the Addition Rare Earth Elements in Fe—Cr—Al Alloys at 1200 C and 1350 C", *High Temperature Corrosion,* pp.267–273, National Association of Corrosion Engineers, Houston, Texas, Mar. 2–6, 1981.

M. Hsiaoyu, "Scanning Electron Microscope Investigation of High–Temperature Oxidation of Fe—23Cr—6Al Alloys (without and with La, Ce or Y Additions)", *Metallic Corrosion,* Proceedings–8th International Congress on Metallic Corrosion, Mainz, Sep. 1981, vol. I, pp. 686–691.

Z. Fuzhong et al, "Effects of Rare Earth Additions on the Cohesion of Oxide Scale in an Fe—Cr—Al Alloy", *Acta Metallurgica Sinica,* 1980, 16(4) 394–400.

Sandvik Steel publication "Strip Steel for Exhaust Catalytic Converters", 1987.

*Primary Examiner*—Sikyin Ip

*Attorney, Agent, or Firm*—Burns, Doane, Swecker & Mathis. L.L.P.

[57] ABSTRACT

The invention provides a ferritic stainless steel alloy useful for strip steel used in exhaust catalytic converters, consisting essentially of in weight %, ≦0.02% C, 19–21% Cr, 4.5–6% Al, 0.01–0.03% Ce, 0.02–0.05% total of rare earth elements, ≧0.015% total Mg+Ca, and balance Fe plus impurities. The alloy can contain 0.2–0.4% Mn, 0.1–0.4% Si, ≦0.5% Ni, ≦0.02% P, ≦0.005% S, ≦0.025% N, 0.015–0.025% Mg, 0.0005–0.0018% Ca, 0.005–0.015% La, 0.02–0.03% Ce, ≦0.015% Ti and ≦0.015% Zr.

18 Claims, 2 Drawing Sheets

U.S. PATENT DOCUMENTS

| | | | |
|---|---|---|---|
| 3,298,826 | 1/1967 | Wukusick | 420/40 |
| 3,499,802 | 3/1970 | Lagneborg | 420/36 |
| 3,698,964 | 10/1972 | Caule et al. | 420/103 |
| 3,746,536 | 7/1973 | Kuse | 420/40 |
| 3,782,925 | 1/1974 | Brandis et al. | 420/40 |
| 3,850,617 | 11/1974 | Umowski | 420/71 |
| 3,873,306 | 3/1975 | Giles et al. | 420/70 |
| 3,885,958 | 5/1975 | Grunbaum et al. | 420/71 |
| 3,920,583 | 11/1975 | Pugh | 502/314 |
| 4,007,038 | 2/1977 | Deverell | 420/40 |
| 4,140,526 | 2/1979 | Moroishi et al. | 420/70 |
| 4,141,762 | 2/1979 | Yamaguchi et al. | 420/40 |
| 4,155,752 | 5/1979 | Oppenheim et al. | 420/40 |
| 4,219,592 | 8/1980 | Anderson et al. | 420/40 |
| 4,230,489 | 10/1980 | Antill | 420/40 |
| 4,244,736 | 1/1981 | Day | 420/40 |
| 4,286,986 | 9/1981 | Borneman | 148/505 |
| 4,299,621 | 11/1981 | Giflo | 420/83 |
| 4,334,923 | 6/1982 | Sherman | 420/40 |
| 4,376,245 | 3/1983 | Linkskog et al. | 420/40 |
| 4,414,023 | 11/1983 | Aggen et al. | 420/40 |
| 4,859,649 | 8/1989 | Böhnke et al. | 420/40 |

FERRITIC STAINLESS STEEL ALLOY FOR USE AS CATALYTIC CONVERTER MATERIAL

This application is a continuation-in-part of application Ser. No. 08/200,362, filed Feb. 23, 1994, abandoned, a continuation of application Ser. No. 07/941,783, filed Sep. 8, 1992, abandoned.

BACKGROUND OF THE INVENTION

1. Field of the Invention

The invention relates to ferritic stainless steel alloys. More particularly, the invention relates to an iron-chromium-aluminum alloy having rare earth and magnesium and/or calcium additions.

2. Description of Related Art

U.S. Pat. No. 4,414,023 discloses a ferritic stainless steel alloy which can be used as a catalytic substrate. The alloy includes, by weight, 8.0–25.0% Cr, 3.0–8.0% Al, at least 0.002% and up to 0.05% Ce, La, Nd, and/or Pr with the total of all rare earths up to 0.06%, up to 4.0% Si, 0.06% to 1.0% Mn and normal steelmaking impurities of less than 0.050% C, less than 0.050% N, less than 0.020% O, less than 0.040% P, less than 0.030% S, less than 0.050% Cu, less than 0.050% Ni, and the sum of Ca and Mg less than 0.005%, the remainder being Fe. The '023 patent discloses that the steel can be heat treated to form an aluminum oxide surface which is adherent and provides for thermal cyclic oxidation resistance. The '023 patent further discloses that known processes for producing alumina whiskers on ion-chromium-aluminum alloys to further increase the surface area and provide more effective catalyst retention on the surface for improving catalyst efficiency include either:

1. Producing a thin strip with a heavily cold-worked surface by removing the strip from a solid log through a machining process called "peeling" and subjecting the strip to 870°–930° C. in air, as disclosed in United Kingdom Patent Application GB 2,063,723 A; or
2. Using a thin strip produced by conventional hot and cold rolling, preconditioning the surface by heating for a short time to temperatures of about 900° C. in an essentially oxygen-free inert atmosphere (less than 0.1% $O_2$), and after cooling to room temperature performing a whisker growing heat treatment in air for longer periods of time at about 925° C.

SUMMARY OF THE INVENTION

The invention provides a ferritic stainless steel alloy useful for strip steel used in exhaust catalytic converters, consisting essentially of, in weight %, ≦0.02% C, 19–21% Cr, 4.5–6% Al, 0.01–0.03% Ce, 0.02–0.05% total of rare earth elements, at least 0.015% total Mg+Ca, and balance Fe plus impurities. The alloy can contain 0.015–0.025% Mg, 0.0005–0.0018% Ca, 0.005–0.015% La, and 0.02–0.03 % Ce.

In addition, the alloy can contain 0.005–0.02% P, ≦0.005% S, ≦0.5% Ni, ≦0.1% Mo, ≦0.1% W, ≦0.1% Co, ≦0.1% V, ≦0.1% Cu, ≦0.1% Sn, ≦0.1% Nb, ≦0.1% N, ≦0.015% Ti and ≦0.015% Zr. According to various aspects of the invention, the alloy can contain a total V, Ti, Nb and/or Zr of 0.05–0.2%, 0.03–0.1% V, ≦0.025% N, 5.0–5.5% Al, 20–21% Cr, ≦0.018% C, 0.2–0.4% Mn, 0.03–0.06% Cu, and 0.1–0.4% Si.

DETAILED DESCRIPTION OF THE PREFERRED EMBODIMENTS

Figure 1:
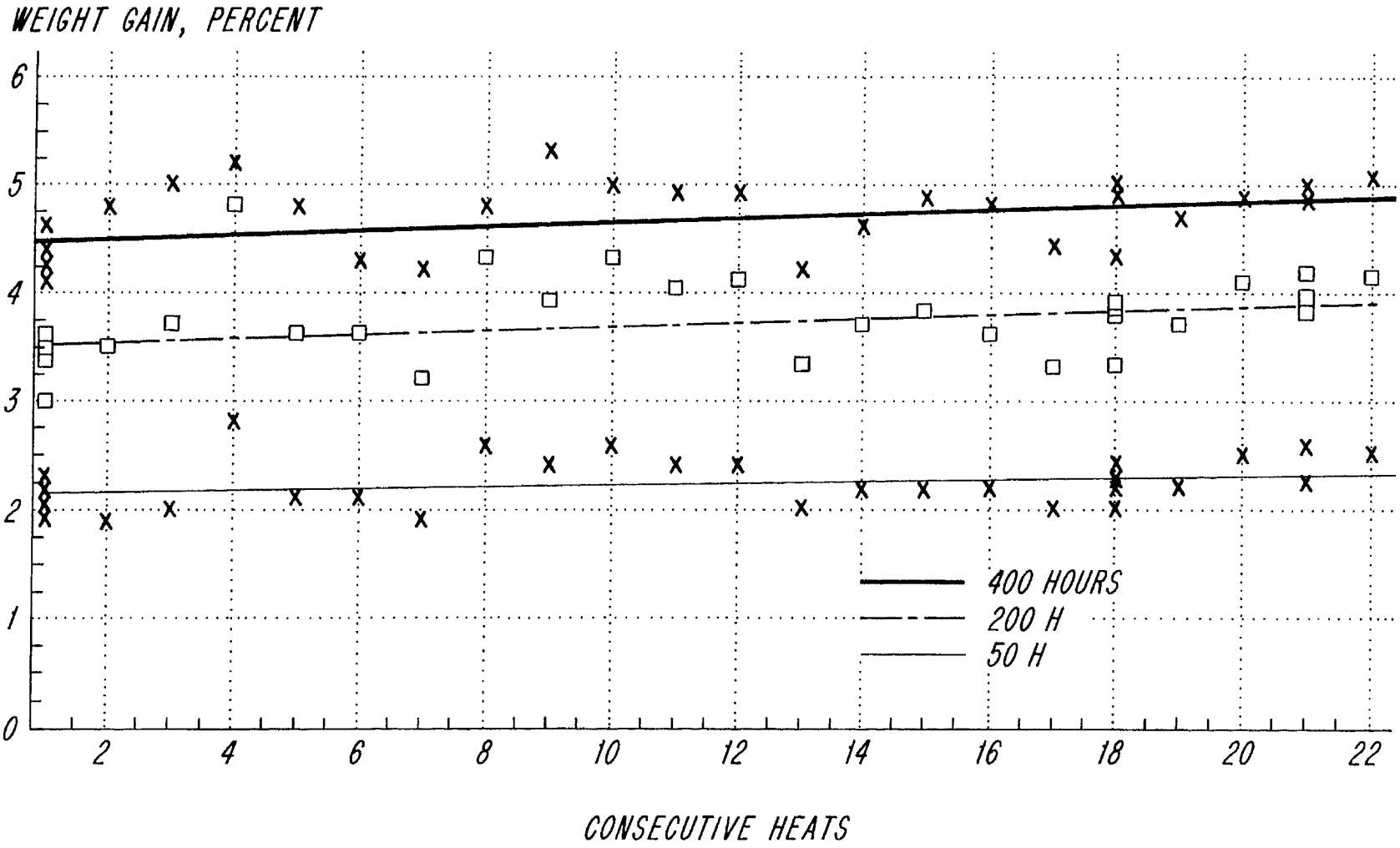
FIG. 1 is a diagram showing high temperature properties of the alloy of the invention.

The present invention provides a ferritic chromium strip steel useful for the manufacture of monoliths for catalytic converters. The steel includes additives of rare earth elements which improve the adhesion of the surface oxide and consequently prevent scaling.

A metal-based monolith offers many advantages in comparison with a ceramic one. For instance, the metal-based monolith provides better thermal conductivity, shorter light-off time and less risk of overheating. In addition, the metal-based monolith can provide thinner walls, less back-pressure, larger effective area, greater catalytic capacity, smaller and more flexible design and easier canning. Further benefits of the metal-based monolith include higher mechanical strength and better resistance to thermal shock. The following Table 1 provides a comparison between a metal-based monolith made from an alloy in accordance with the invention and a ceramic monolith. The table is as follows:

TABLE 1

| Properties | Metal-Based Monolith | Ceramic Based Monolith |
|---|---|---|
| Wall thickness, mm | 0.04 | 0.15 |
| Number of cells, $inch^2$ | 400 | 400 |
| Free Section Area, % | 92 | 76 |
| Effective Area, $m^2/dm^3$ | 3.2 | 2.4 |
| Specific Heat, J/kg°C. (0–100° C.) | 500 | 1050 |
| Thermal Conductivity, W/m°C. | | |
| at 20° C. | 14 | 1.0 |
| at 600° C. | 20 | 0.8 |
| Density, $g/cm^3$ | 7.3 | 2.6 |

For purposes of forming metal-based monoliths, the steel of the invention can be supplied in the form of soft-annealed or cold-rolled strip in widths up to 190.5 mm (7 inch) in coils. The standard thicknesses are 0.04, 0.05mm and 0.08 mm (0.00158, 0.002 and 0.003 inch). Of course, other thicknesses can be used for such metal-based monoliths.

Mechanical properties of the steel strip according to the invention are set forth in the following Table 2:

TABLE 2

MECHANICAL PROPERTIES

Nominal values at 20° C. (68° F.). As delivered.

| | Yield strength 0.2% | | Tensile strength | | Elong. A5* |
|---|---|---|---|---|---|
| Condition | $N/mm^2$ | psi | $N/mm^2$ | psi | % |
| Soft-annealed | 480 | 69 600 | 670 | 97 150 | 25 |
| Cold rolled | 1000 | 145 000 | 1050 | 152 250 | <1 |

TABLE 2-continued

MECHANICAL PROPERTIES

Nominal values at elevated temperatures.

| Temperature | | Yield Strength 0,2% | | Tensile strength | | Elong. A5* |
|---|---|---|---|---|---|---|
| °C. | °F. | N/mm² | psi | N/mm² | psi | % |
| 20 | 70 | 480 | 69 600 | 670 | 97 150 | 25 |
| 200 | 390 | 325 | 47 125 | 580 | 84 100 | 25 |
| 300 | 570 | 310 | 44 950 | 570 | 82 650 | 25 |
| 400 | 750 | 305 | 44 225 | 535 | 77 575 | 25 |
| 500 | 930 | 285 | 41 325 | 385 | 55 825 | 30 |
| 600 | 1110 | 110 | 15 950 | 335 | 48 575 | 60 |
| 700 | 1290 | 50 | 7 250 | 140 | 20 300 | 90 |
| 800 | 1470 | 40 | 5 800 | 70 | 10 150 | 105 |
| 900 | 1650 | 20 | 2 900 | 40 | 5 800 | 150 |

*A5 corresponds to $5.65\sqrt{S_o}$

Physical properties of the steel according to the invention are set forth in Table 3 as follows:

TABLE 3

PHYSICAL PROPERTIES

Density . . . 7.3 g/cm³ (0.27 lb/in³)
Melting point . . . 1470° C. (2680° F.)

| Temp. °C. | Resistivity μΩm | Specific heat capacity, J/kg°C. | Thermal conductivity, W/m°C. |
|---|---|---|---|
| 20 | 1.38 | 481 | 11.7 |
| 100 | 1.38 | 517 | 12.8 |
| 200 | 1.38 | 559 | 14.3 |
| 300 | 1.39 | 603 | 15.8 |
| 400 | 1.40 | 663 | 17.1 |
| 500 | 1.42 | 796 | 19.1 |
| 556* | 1.44 | 918 | 19.7 |
| 600 | 1.44 | 778 | 19.5 |
| 700 | 1.45 | 721 | 21.4 |
| 800 | 1.46 | 715 | 22.9 |

THERMAL EXPANSION

| Temp. °C. | Per °C. × $10^{-6}$ | Temp. °C. | Per °C. × $10^{-6}$ |
|---|---|---|---|
| 20–100 | 11.7 | 20–600 | 13.3 |
| 20–200 | 12.1 | 20–700 | 13.8 |
| 20–300 | 12.4 | 20–800 | 14.3 |
| 20–400 | 12.6 | 20–900 | 14.9 |
| 20–500 | 13.0 | 20–1000 | 15.5 |

Figure 2:
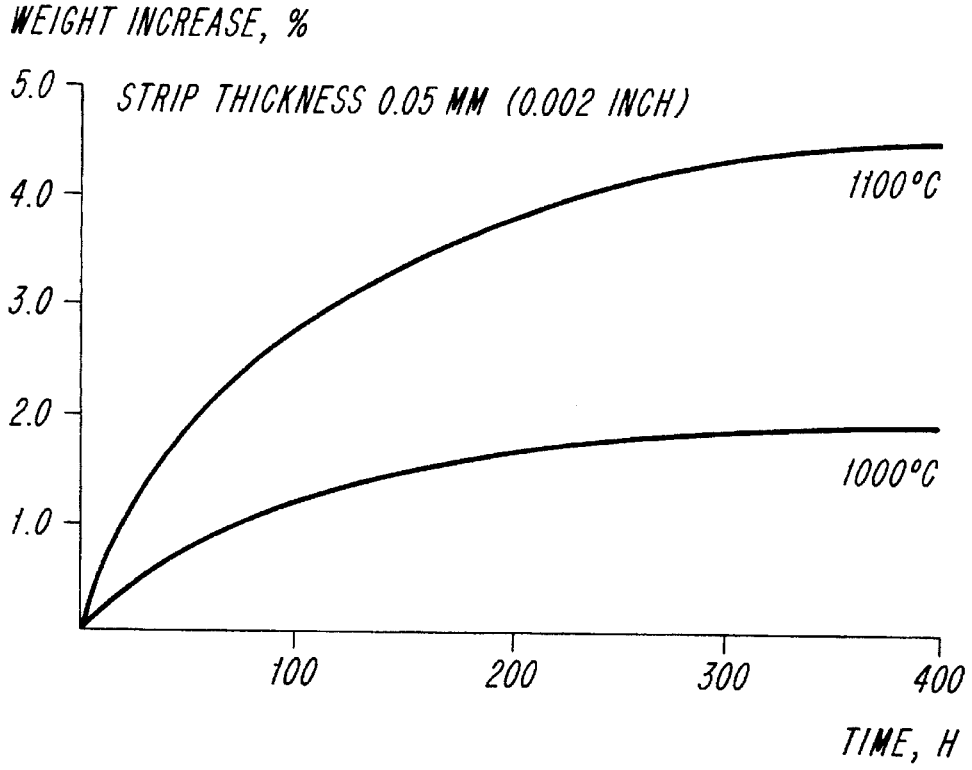
FIG. 2 shows static oxidation properties of the alloy of the invention.
Figure 3:
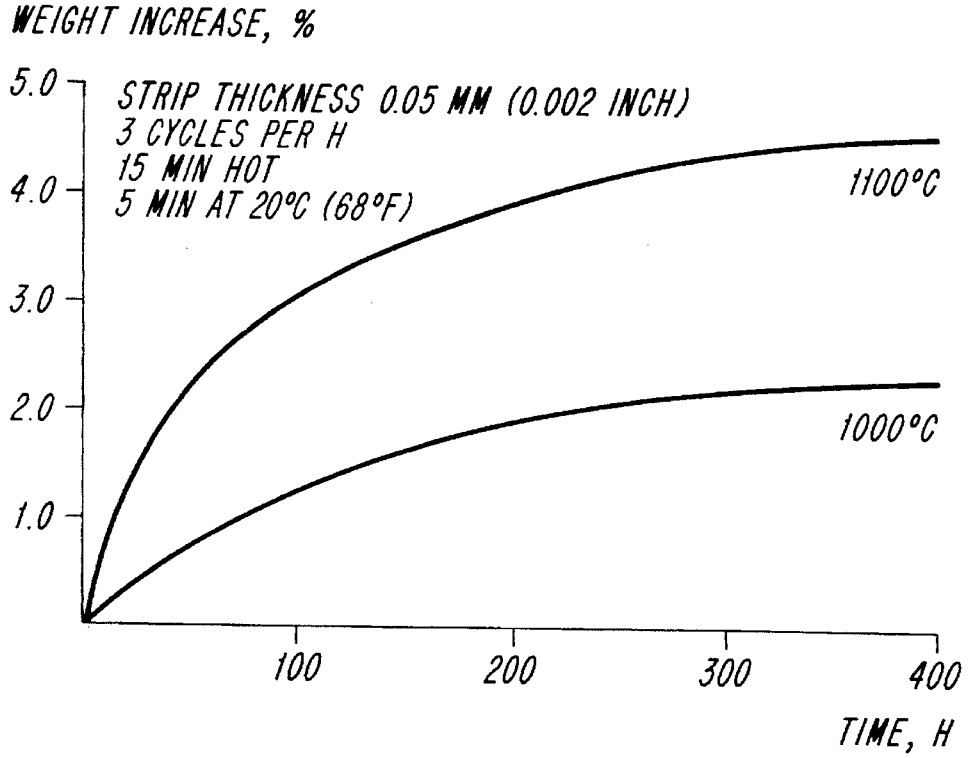
FIG. 3 shows cyclic oxidation properties of the alloy of the invention.

Oxidation properties of the steel according to the invention are shown in FIGS. 1–3. FIG. 1 is a diagram showing weight gain in quasistatic oxidation tests wherein samples held in a furnace at 1100° C. with an air atmosphere were taken out of the furnace after 1, 5, 25, 50, 100, 150, 200, etc., up to 400 hours. FIG. 2 shows weight increase for static oxidation at 1000° C. and 1100° C. for strip thickness of 0.05 mm (0.002 inch). FIG. 3 shows weight increase for cyclic conditions of three cycles per hour with each cycle including fifteen minutes at either 1000° C. or 1100° C. and five minutes at 20° C. (68° F.).

The steel according to the invention can be manufactured by producing a melt of the desired analysis, casting, hot rolling and cold rolling to thin sheets. The steel composition preferably includes, by weight, ≦0.018% C, 19–21% Cr, 4.5–6.0% Al, ≦0.025% N, 0.010–0.030% Ce, ≧0.015% Mg, ≧0.0005% Ca, ≦0.5% Si, ≦0.5% Mn, ≦0.5% Ni, ≦0.015% Ti, ≦0.015% Zr, and the balance being Fe and impurities.

The alloy of the invention preferably includes a Mg content which provides damage-free surfaces on the hot- and cold-rolled sheets. If the Mg-content is too high, pores can be formed in the material which result in surface defects such as cracks in the sheet when subjected to cold rolling down to small dimensions. Ca should also be controlled to avoid adverse effects on oxidation properties. Ti and Zr can also adversely effect oxidation of Al and therefore should be kept at low values. Examples of alloys in accordance with the invention are set forth in the following Table 4 wherein the amounts are in weight %.

TABLE 4

| Element | 1 | 2 | 3 | 4 | 5 | 6 |
|---|---|---|---|---|---|---|
| C | 0.011 | 0.008 | 0.008 | 0.013 | 0.017 | 0.009 |
| Si | 0.34 | 0.20 | 0.22 | 0.21 | 0.31 | 0.18 |
| Mn | 0.26 | 0.26 | 0.29 | 0.34 | 0.30 | 0.30 |
| P | 0.012 | 0.012 | 0.011 | 0.015 | 0.011 | 0.012 |
| S | 0.001 | 0.001 | 0.001 | 0.001 | 0.001 | 0.001 |
| Cr | 20.21 | 20.23 | 20.27 | 20.11 | 20.38 | 20.56 |
| Ni | 0.28 | 0.23 | 0.29 | 0.31 | 0.24 | 0.14 |
| Mo | 0.01 | 0.01 | 0.02 | 0.02 | 0.01 | 0.01 |
| W | 0.01 | 0.01 | 0.01 | 0.01 | 0.01 | 0.01 |
| Co | 0.018 | 0.010 | 0.014 | 0.013 | 0.013 | 0.013 |
| V | 0.041 | 0.038 | 0.033 | 0.055 | 0.055 | 0.091 |
| Ti | 0.01 | 0.01 | 0.01 | 0.01 | 0.01 | 0.01 |
| Cu | 0.042 | 0.036 | 0.045 | 0.052 | | |
| Al | 5.3 | 5.2 | 5.3 | 5.3 | 5.2 | 5.4 |
| Sn | 0.014 | 0.013 | 0.013 | 0.013 | 0.013 | 0.013 |
| Nb | 0.01 | 0.01 | 0.01 | 0.01 | 0.01 | 0.01 |
| Zr | 0.010 | 0.015 | 0.015 | 0.005 | 0.005 | 0.005 |
| N | 0.007 | 0.009 | 0.005 | 0.015 | 0.019 | 0.011 |
| Ce | 0.023 | 0.028 | 0.03 | 0.029 | 0.028 | 0.019 |
| Mg | 0.022 | 0.018 | 0.018 | 0.025 | 0.015 | 0.019 |
| Ca | 0.0011 | 0.0005 | 0.001 | 0.0018 | 0.0012 | 0.0005 |
| La | 0.008 | 0.011 | 0.013 | 0.010 | 0.009 | 0.006 |

Examples of alloys in accordance with the invention are set forth in the following Table 5 wherein the alloys include ≦0.018% C, 19–21% Cr, 4.5–6.0% Al, ≦0.025% N, 0.015% Mg, ≦0.5% Si, ≦0.5% Mn, ≦0.5% Ni, the balance being Fe and the elements shown in Table 5 wherein the amounts are in parts per million (ppm).

TABLE 5

| Sample | B | Ti | Zn | As | Y | Zr | Nb | Mo | Sn | Sb | Hf | W | Pb | Ce | La | Pr | Nd | Li | Be | Sc | Ag | Cd | Te |
|---|---|---|---|---|---|---|---|---|---|---|---|---|---|---|---|---|---|---|---|---|---|---|---|
| 7 | 2 | 55 | 22 | 23 | 0.8 | 3 | 3 | 61 | 22 | 3 | <0.1 | 8 | 0.6 | 198 | 46 | 12 | 48 | <0.1 | <0.1 | 3 | <0.1 | 0.2 | <0.1 |
| 8 | <0.5 | 51 | 15 | 26 | 0.2 | 3 | 4 | 114 | 24 | 3 | <0.1 | 11 | 0.3 | 238 | 73 | 15 | 70 | <0.1 | <0.1 | 3 | <0.1 | 0.1 | <0.1 |
| 9 | <0.5 | 35 | 10 | 25 | 0.2 | 2 | 1 | 171 | 21 | 3 | <0.1 | 8 | 0.1 | 282 | 92 | 18 | 87 | <0.1 | <0.1 | 8 | <0.1 | 0.5 | <0.1 |
| 10 | 2 | 121 | 18 | 24 | 0.2 | 4 | 5 | 142 | 38 | 3 | <0.1 | 13 | 0.2 | 190 | 55 | 12 | 57 | 0.4 | 0.1 | 5 | <0.1 | 0.4 | <0.1 |
| 11 | 0.5 | 38 | 12 | 25 | 0.1 | 3 | 4 | 60 | 21 | 2 | <0.1 | 8 | <0.1 | 209 | 64 | 13 | 63 | <0.1 | <0.1 | 3 | <0.1 | 0.2 | <0.1 |
| 12 | 2 | 56 | 7 | 22 | 0.3 | 3 | 4 | 149 | 36 | 2 | <0.1 | 9 | 0.1 | 233 | 68 | 15 | 68 | <0.1 | <0.1 | 3 | <0.1 | 0.2 | <0.1 |
| 13 | <0.5 | 40 | 9 | 21 | 0.2 | 3 | 4 | 67 | 19 | 2 | <0.1 | 15 | 0.1 | 192 | 50 | 12 | 55 | <0.1 | <0.1 | 3 | 0.2 | 0.3 | <0.1 |
| 14 | <0.5 | 35 | 10 | 23 | <0.1 | 2 | 2 | 101 | 22 | 3 | <0.1 | 14 | <0.1 | 215 | 62 | 14 | 61 | <0.1 | <0.1 | 2 | 0.2 | 0.3 | <0.1 |
| 15 | 1 | 59 | 65 | 18 | 0.1 | 2 | 4 | 41 | 14 | 2 | <0.1 | 5 | 0.6 | 207 | 56 | 13 | 60 | <0.1 | <0.1 | 2 | 0.1 | 0.3 | <0.1 |

TABLE 5-continued

| | | | | | | | | | | | | | | | | | | | | | | | |
|---|---|---|---|---|---|---|---|---|---|---|---|---|---|---|---|---|---|---|---|---|---|---|---|
| 16 | 2 | 74 | 16 | 26 | 0.1 | 3 | 12 | 196 | 39 | 5 | <0.1 | 11 | 0.3 | 257 | 65 | 15 | 75 | <0.1 | <0.1 | 4 | 0.1 | 0.3 | <0.1 |
| 17 | 4 | 75 | 11 | 27 | <0.1 | 4 | 9 | 179 | 14 | 3 | <0.1 | 11 | 0.3 | 211 | 68 | 13 | 52 | <0.1 | <0.1 | 3 | 0.1 | 0.1 | <0.1 |
| 18 | 63 | 50 | 6 | 22 | 0.2 | 2 | 10 | 115 | 14 | 5 | <0.1 | 9 | 0.2 | 232 | 82 | 13 | 38 | 0.1 | <0.1 | 3 | 0.2 | 0.1 | <0.1 |
| 19 | 4 | 48 | 9 | 19 | 0.1 | 2 | 2 | 40 | 12 | 3 | <0.1 | 4 | <0.1 | 212 | 65 | 11 | 11 | <0.1 | <0.1 | 3 | <0.1 | 0.1 | <0.1 |
| 20 | 17 | 74 | 19 | 7 | <0.1 | 2 | 8 | 94 | 15 | 4 | <0.1 | 11 | 0.9 | 228 | 57 | 12 | 13 | <0.1 | <0.1 | 3 | 0.3 | 0.2 | 0.2 |
| 21 | 1 | 82 | 17 | 22 | <0.1 | 2 | 7 | 102 | 12 | 3 | <0.1 | 7 | 0.2 | 295 | 95 | 17 | 20 | <0.1 | <0.1 | 5 | 0.1 | 0.3 | <0.1 |
| 22 | 3 | 97 | 8 | 24 | 0.1 | 3 | 9 | 97 | 13 | 3 | <0.1 | 5 | 0.1 | 261 | 88 | 14 | 59 | <0.1 | <0.1 | 5 | <0.1 | <0.1 | <0.1 |
| 23 | 2 | 40 | 5 | 26 | <0.1 | 2 | 5 | 240 | 15 | 4 | <0.1 | 11 | <0.1 | 270 | 84 | 15 | 63 | 0.1 | <0.1 | 4 | 0.2 | 0.6 | <0.1 |
| 24 | 13 | 115 | 17 | 11 | 0.1 | 6 | 7 | 128 | 16 | 4 | <0.1 | 7 | <0.1 | 244 | 77 | 14 | 43 | <0.1 | 0.1 | 5 | 0.2 | 0.1 | <0.1 |
| 25 | 3 | 103 | 25 | 30 | 0.2 | 65 | 5 | 116 | 23 | 10 | 0.8 | 18 | 0.4 | 263 | 83 | 18 | 78 | <0.1 | <0.1 | 4 | 0.2 | <0.1 | <0.1 |
| 26 | 20 | 33 | 28 | 22 | 1.3 | 3 | 2 | 100 | 27 | 4 | <0.1 | 12 | 0.3 | 311 | 76 | 19 | 73 | <0.1 | <0.1 | 2 | <0.1 | 0.4 | <0.1 |
| 27 | 2 | 103 | 13 | 28 | 1.8 | 2 | 2 | 105 | 18 | 4 | <0.1 | 9 | 0.1 | 286 | 67 | 18 | 66 | <0.1 | <0.1 | 5 | <0.1 | <0.1 | <0.1 |

| Sample | Ba | Sm | Eu | Gd | Tb | Dy | Ho | Er | Tm | Yb | Lu | Ta | Os | Ir | Pt | Au | Hg | Tl | Bi | Th | U |
|---|---|---|---|---|---|---|---|---|---|---|---|---|---|---|---|---|---|---|---|---|---|
| 7 | 1 | 1 | 0.3 | 18 | 1 | 4 | 0.5 | 1 | 0.2 | 0.1 | <0.1 | 1 | 0.9 | 0.1 | <0.1 | <0.1 | <0.1 | <0.1 | <0.1 | 0.1 | 0.3 |
| 8 | 1 | 1 | 0.1 | 6 | 0.4 | 0.4 | <0.1 | 0.6 | 0.2 | <0.1 | <0.1 | 1 | 0.7 | 0.1 | <0.1 | <0.1 | <0.1 | <0.1 | <0.1 | <0.1 | 0.3 |
| 9 | 2 | 1 | 0.1 | 6 | 0.4 | 0.6 | <0.1 | 0.7 | 0.2 | <0.1 | <0.1 | 0.1 | 0.3 | 0.2 | <0.1 | <0.1 | <0.1 | <0.1 | <0.1 | <0.1 | 0.3 |
| 10 | 2 | 0.9 | <0.1 | 4 | 0.3 | 0.6 | <0.1 | 0.5 | 0.2 | <0.1 | <0.1 | 0.3 | 0.5 | <0.1 | 0.1 | <0.1 | 0.3 | 1 | <0.1 | <0.1 | 0.6 |
| 11 | 1 | 1 | 0.1 | 4 | 0.4 | 0.2 | <0.1 | 0.4 | 0.3 | <0.1 | <0.1 | 0.2 | 0.4 | 0.2 | <0.1 | <0.1 | <0.1 | <0.1 | <0.1 | <0.1 | 0.5 |
| 12 | 1 | 0.6 | <0.1 | 7 | 0.5 | 7 | 0.1 | 0.9 | 0.3 | <0.1 | <0.1 | 0.3 | 0.2 | 0.1 | <0.1 | <0.1 | <0.1 | <0.1 | <0.1 | <0.1 | 0.4 |
| 13 | 1 | 1 | <0.1 | 6 | 0.6 | 1 | 0.1 | 0.8 | 0.2 | <0.1 | <0.1 | 0.2 | 0.7 | <0.1 | <0.1 | <0.1 | <0.1 | <0.1 | <0.1 | <0.1 | 0.5 |
| 14 | 1 | 1 | <0.1 | 3 | 0.2 | 0.2 | <0.1 | 0.5 | 0.2 | <0.1 | <0.1 | 0.3 | 0.6 | 0.1 | <0.1 | <0.1 | <0.1 | 0.1 | <0.1 | <0.1 | 0.4 |
| 15 | 1 | 0.8 | <0.1 | 4 | 0.3 | 0.5 | <0.1 | 0.2 | 0.1 | 0.1 | <0.1 | 0.1 | 0.5 | 0.1 | <0.1 | <0.1 | <0.1 | <0.1 | <0.1 | <0.1 | 0.5 |
| 16 | 1 | 0.6 | <0.1 | 5 | 0.3 | 0.5 | <0.1 | 0.7 | 0.2 | <0.1 | <0.1 | 0.4 | 0.8 | 0.1 | <0.1 | <0.1 | <0.1 | <0.1 | <0.1 | <0.1 | 0.4 |
| 17 | 1 | 0.7 | 0.1 | 3 | 0.3 | 0.2 | <0.1 | 0.5 | 0.3 | 0.1 | <0.1 | 0.4 | 0.6 | 0.1 | <0.1 | <0.1 | 0.1 | <0.1 | <0.1 | <0.1 | 0.4 |
| 18 | 2 | 0.8 | <0.1 | 2 | 0.1 | <0.1 | <0.1 | 0.3 | 0.2 | <0.1 | <0.1 | 0.1 | 1 | <0.1 | <0.1 | <0.1 | 0.3 | <0.1 | <0.1 | <0.1 | 0.3 |
| 19 | 1 | 0.8 | 0.1 | 2 | <0.1 | <0.1 | <0.1 | 0.3 | 0.2 | <0.1 | <0.1 | 0.2 | 1 | 0.2 | <0.1 | <0.1 | <0.1 | <0.1 | <0.1 | <0.1 | 0.3 |
| 20 | 2 | 0.6 | <0.1 | 2 | <0.1 | <0.1 | <0.1 | <0.1 | <0.1 | <0.1 | <0.1 | 0.3 | 1 | 0.1 | <0.1 | <0.1 | <0.1 | <0.1 | <0.1 | <0.1 | 0.4 |
| 21 | 2 | 0.9 | <0.1 | 2 | 0.1 | <0.1 | <0.1 | 0.6 | 0.2 | <0.1 | <0.1 | 0.5 | 0.9 | 0.1 | <0.1 | <0.1 | <0.1 | <0.1 | <0.1 | <0.1 | 0.3 |
| 22 | 2 | 0.6 | <0.1 | 3 | 0.2 | <0.1 | <0.1 | 0.3 | 0.1 | <0.1 | <0.1 | 0.3 | 0.9 | 0.1 | 0.1 | <0.1 | <0.1 | <0.1 | <0.1 | <0.1 | 0.7 |
| 23 | 2 | 0.8 | <0.1 | 3 | 0.1 | <0.1 | <0.1 | 0.5 | 0.2 | <0.1 | <0.1 | 0.2 | 1 | 0.2 | <0.1 | <0.1 | <0.1 | <0.1 | <0.1 | <0.1 | 0.3 |
| 24 | 2 | 0.6 | 0.2 | 2 | 0.3 | <0.1 | <0.1 | 0.2 | 0.3 | <0.1 | <0.1 | 0.4 | 0.8 | 0.3 | 0.2 | <0.1 | <0.1 | <0.1 | <0.1 | <0.1 | 0.7 |
| 25 | 2 | 0.7 | <0.1 | 3 | 0.2 | <0.1 | <0.1 | 0.3 | 0.2 | <0.1 | <0.1 | 0.2 | 0.9 | <0.1 | <0.1 | <0.1 | <0.1 | <0.1 | <0.1 | <0.1 | 0.5 |
| 26 | 2 | 1 | <0.1 | 22 | 2 | 7 | 0.6 | 2 | 0.2 | <0.1 | <0.1 | 0.6 | 0.7 | <0.1 | <0.1 | <0.1 | <0.1 | <0.1 | <0.1 | <0.1 | 0.5 |
| 27 | 8 | 0.7 | 0.1 | 22 | 2 | 7 | 0.8 | 1 | 0.3 | <0.1 | <0.1 | 0.2 | 0.8 | 0.2 | <0.1 | <0.1 | 0.2 | <0.1 | <0.1 | <0.1 | 0.6 |

While the invention has been described with reference to the foregoing embodiments, various changes can be made thereto which fall within the scope of the appended claims.

What is claimed is:

1. A ferritic stainless steel alloy useful as catalytic converter material consisting essentially, by weight, of:

≦0.02% C

19–21% Cr 4.5–6% Al 0.01–0.03% Ce 0.02–0.05% total of rare earth elements

≦0.015% Ti

≦0.005% Zr

≧0.015% Mg+Ca

≦0.05% Mo

≦0.007% N balance Fe plus impurities, a total amount of Mg and Ca being less than an amount which adversely affects surface rolling and oxidation properties of the alloy.

2. The alloy of claim 1 containing 0.015–0.025% Mg.

3. The alloy of claim 1, containing 0.0005–0.0018% Ca.

4. The alloy of claim 1, containing no greater than about 0.03% Mg+Ca.

5. The alloy of claim 1, containing a total of V, Ti, Nb and Zr of 0.05–0.2%.

6. The alloy of claim 1, containing ≦0.025% N.

7. The alloy of claim 1, containing 5.0–5.5% Al.

8. The alloy of claim 1, containing 20–21% Cr.

9. The alloy of claim 1, containing ≦0.018% C.

10. The alloy of claim 1, containing 0.03–0.1% V.

11. The alloy of claim 1, containing 0.008–0.02% C.

12. The alloy of claim 1, containing 0.2–0.4% Mn.

13. The alloy of claim 1, containing 0.03–0.06% Cu.

14. The alloy of claim 1, containing 0.1–0.4% Si.

15. The alloy of claim 1, containing ≦0.5% Ni.

16. The alloy of claim 1, containing ≦0.02% P and ≦0.005% S.

17. The alloy of claim 1, containing 0.005–0.015% La.

18. The alloy of claim 1, containing 0.02–0.03% Ce.

* * * * *